United States Patent [19]

Rifat

[11] 4,307,746

[45] Dec. 29, 1981

[54] FROST-PROOF FIRE HYDRANT

[76] Inventor: Sultan A. Rifat, 159 Gelston Ave., Brooklyn, N.Y. 11209

[21] Appl. No.: 54,294

[22] Filed: Jul. 2, 1979

Related U.S. Application Data

[63] Continuation-in-part of Ser. No. 34,344, Apr. 30, 1979.

[51] Int. Cl.[3] ..... E03B 9/02

[52] U.S. Cl. ..... 137/291; 137/304; 251/116; 251/291

[58] Field of Search ..... 137/272, 294, 291, 296; 251/89, 111, 113, 116, 291

[56] References Cited

U.S. PATENT DOCUMENTS 633,228 9/1899 Cholodkowsky ..... 251/113 X 1,134,415 4/1915 Peerstone ..... 251/116

3,532,108 10/1970 Sullivan ..... 137/296

3,532,109 10/1970 Smith ..... 137/296

FOREIGN PATENT DOCUMENTS 141419 4/1935 Austria ..... 251/113

*Primary Examiner*—Alan Cohan

*Attorney, Agent, or Firm*—Hubbell, Cohen, Stiefel & Gross

[57] ABSTRACT

A frost-proof fire hydrant of the type wherein the valve is biased towards its open position by the fluid pressure in the shoe. The fire hydrant includes improved means disposed in the bonnet and cooperating with the valve stem for maintaining the valve in the closed position against the water pressure in the shoe.

10 Claims, 3 Drawing Figures

FROST-PROOF FIRE HYDRANT

CROSS-REFERENCE TO RELATED APPLICATIONS

This application is a continuation-in-part of my copending application Ser. No. 034,344, filed Apr. 30, 1979, the contents of which are incorporated herein by reference in their entirety.

BACKGROUND OF THE INVENTION

1. Field of the Invention

This invention relates generally to fire hydrants, and more particularly to improvements in fire hydrants of the frostproof type.

2. Statement of the Prior Art

Fire hydrants of the type including a valve stem and a connected valve supported for reciprocating movement in a vertical barrel are, of course, well known. Typically, such hydrants include a bonnet secured to the barrel, the bonnet having an internally threaded aperture which receives the externally threaded upper end of the valve stem. Alternatively, the lower end of the valve stem may be threaded and received in an internally threaded nut seated in the shoe, below the valve. In such hydrants, the valve stem is reciprocated by rotating the valve stem relative to the bonnet. Generally, the valve stem is rotated by a wrench or the like which fits about a suitably shaped projection at the top of the valve stem which protrudes through the bonnet. Fire hydrants fitting this general description may be found in sales brochures distributed by Waterous, South Saint Paul, Minnesota; Kennedy Valve Manufacturing Co., Inc., Elmira, New York; United States Pipe and Foundry Company, Smith Valve and Hydrant Division, East Orange, N.J.; and Clow Corporation, Eddy-Iowa Division, Oskaloosa, Iowa.

The desirability of seating the valve above its seat so that the water pressure in the shoe biases the valve to the open position to reduce opening time has also be recognized. Such arrangements also reduce water hammer upon closing since the valve cannot jump to its seat but rather closes gradually against the water pressure. Hydrants operating according to this principle are also disclosed in the above-mentioned literature, particularly the Clow brochure. See also U.S. Pat. No. 2,580,197.

Still others have recognized that the accumulation of water and subsequent freezing thereof between the mating threads of the valve stem and the bonnet or nut which holds it in place can block reciprocating movement of the stem to open the valve, as can corrosion of the threaded components. Based on this, fire hydrants using means other than mating threaded members to accomplish reciprocating movement of the valve stem and connected valve have been suggested. See, for example, U.S. Pat. No. 202,316 wherein a lever secured to the stem and projected through the side of the barrel is used to reciprocate the stem and the connected valve. See also U.S. Pat. Nos. 3,532,108 and 3,532,109, wherein the valve stem is reciprocated by a detachable mechanism securable to the bonnet for engagement with the top of the valve stem protruding therethrough. In each of these patents, however, the hydrant disclosed is of the type wherein the valve is biased to the closed position by the water pressure in the shoe.

Where non-threaded arrangements are used with hydrants wherein the water pressure biases the valve to the open position, means must be provided for securing the valve in the closed position until opening is desired. In U.S. Pat. No. 2,580,197, this is accomplished by a coil spring disposed about the upper portion of the valve stem and having one end seated on the bonnet and the other end seated on a flange secured to the stem. Thus, the force exerted by the spring on the flange biases the valve stem to the closed position against the water pressure in the shoe. A handle extending through the top of the bonnet is provided for moving the valve stem against the bias of the spring for opening the valve. In arrangements of this type, it is apparent that the coil spring is continuously in opposition to the water pressure acting on the valve. Thus, after a period of time, the spring may lose its elasticity and even break.

SUMMARY OF THE INVENTION

According to the invention, I have developed an improved fire hydrant of the type wherein the valve is normally biased towards the open position by the water pressure in the shoe and wherein the valve stem is reciprocated in the barrel by means other than mating threads. The hydrant is specifically intended for locations such as industrial plants, where tampering is not expected. However, it will be apparent from the description that follows that the hydrant may be rendered "tamper proof" by suitable modifications.

The improvement comprises an improved mechanism for securing the valve in the closed position against the water pressure in the shoe. The preferred mechanism comprises a pin secured to the bonnet for movement between a first position wherein the pin is received in a notch in the valve stem for holding the valve in the closed position and a second position wherein the pin is out of the notch and the valve stem and connected valve are freed for movement to the open position under the influence of the water pressure in the shoe. The pin is preferably movable by a lever secured to the pin and extending through the bonnet. Most preferably, the mechanism includes means, such as a spring, for biasing the pin to the first position. To close the valve, the hydrant also includes means for reciprocating the valve stem in the barrel when the pin is in the second position for moving the valve stem against the water pressure in the shoe.

Further features and advantages of the hydrant according to the present invention will be more fully apparent from the following detailed description and annexed drawings of the preferred embodiment thereof.

DETAILED DESCRIPTION OF THE PREFERRED EMBODIMENT

Figure 1:
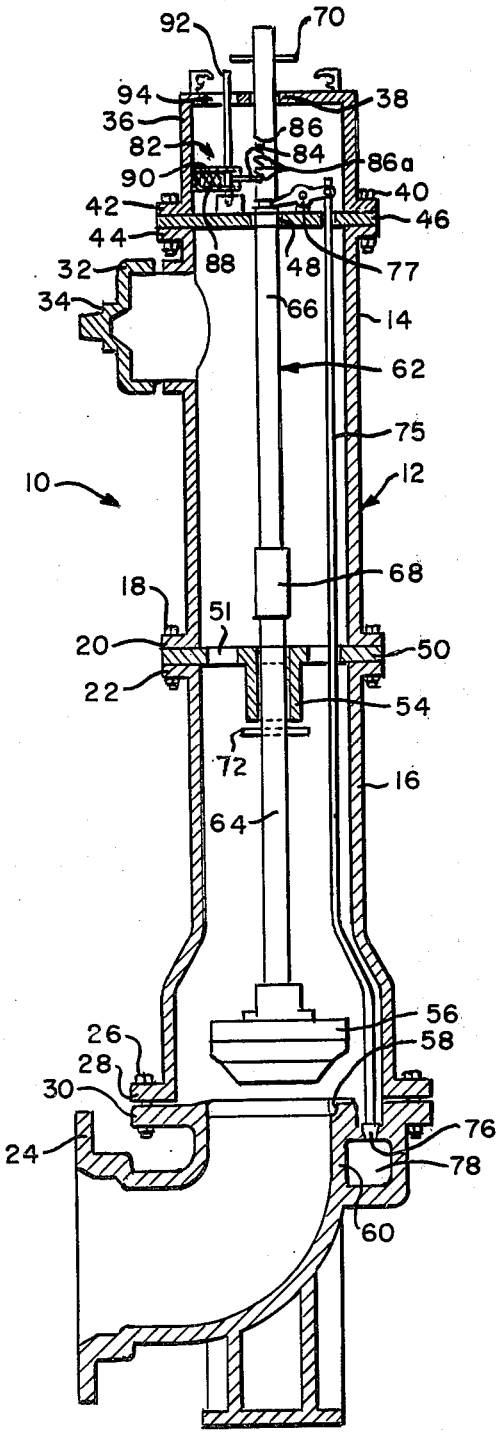
FIG. 1 is an elevational view, partly in section, of the improved hydrant according to the present invention showing the valve in the open position.

Referring now to the drawings, the preferred fire hydrant in accordance with the present invention is generally designated at 10. Hydrant 10 includes a barrel 12 formed as upper and lower sections 14 and 16, respectively, connected by frangible bolt means 18 extending through confronting flanges 20 and 22 at the ground line. The lower barrel section 16 is connected at its lower end to a hydrant shoe 24 as by bolt means 26 extending through confronting flanges 28 and 30. As is usual, upper barrel section 14 includes one or more nozzles 32 covered by nozzle caps 34 which are removed when the hydrant 10 is in use. A bonnet 36 having a preferably centered axial thru hole 38 is secured to the upper barrel section 14 as by bolt means 40 extending through confronting flanges 42 and 44 on the bonnet and upper barrel section, respectively. As presently preferred and shown, a support plate 46 having a hole 48 aligned with hole 38 in bonnet 36 is disposed between flanges 42 and 44 and secured therebetween by the bolt means 40. Another plate 50 having a hole 52 aligned with holes 38 and 48 and a depending cylindrical guide 54 is preferably disposed between flanges 20 and 22 and secured therebetween by bolt means 18. As shown, plate 50 also has one or more passages 51 for accommodating water flow from lower barrel section 16 to upper barrel section 14.

Hydrant 10 also includes a preferably rubber faced valve 56 which seats in its closed position in a preferably rubber faced valve seat 58 in the upper section 60 of the shoe 24. As shown, the valve 56 is biased to its open position by the water pressure in the shoe 24. A valve stem 62 extending through barrel 12 and bonnet 36 is connected at one end to the valve 56 and protrudes at its other end through hole 38. The stem 62 is preferably formed in two sections, a lower section 64 and an upper section 66 joined by a frangible coupling 68 which is aligned with the juncture of barrel sections 14 and 16 when valve 56 is in its closed position. Frangible bolt means 18 and frangible coupling 68 avoid damage to the lower sections of the hydrant in the event of damage to hydrant 10 above the ground line. Valve stem 62 also preferably includes a transverse bar 70 at its upper end and a travel stop 72 on the lower section 64. To prevent water in the barrel 12 from entering the bonnet 36, a seal is preferably disposed in the hole 48 about the stem 62. In accordance with conventional practice, a drain assembly comprising drain rod 75, drain valve 76 and lever 77 is supported in barrel 12 for reciprocating movement in response to the movement of stem 62. As shown, the drain valve 76 is disposed in a bore communicating with a preferably open ended drainage chamber 78 formed in upper shoe section 60. It will thus be apparent that when the valve 56 is moved to its closed position pivoting of lever 77 will move rod 75 and connected drain valve 76 upward and excess water in the barrel 12 will drain through the chamber 78. It will be equally apparent that when the valve 56 is moved to its open position, the drain valve 76 will block the flow of water into the chamber 78 thereby preventing the escape of water.

According to the invention, hydrant 10 includes means 82 for holding valve 56 in its closed position against the water pressure in the shoe 24. Preferred means 82 includes a pin 84 having one end aligned with an angular notch 86 in the valve stem 62 when the valve 56 is in its closed position. The other end of the pin 84 is connected to means, such as the coil spring 88, for biasing the pin 84 towards the stem 62. Spring 88 is preferably seated in a housing 90 secured to the side wall of the bonnet 36. As presently preferred and shown, the pin 84 is movable out of the notch 86 against the bias of the coil spring 88 by a lever 92. The lever 92 preferably extends through a hole in the pin provided for this purpose. As shown, the upper end of the lever 92 extends through an aperture 94 in the bonnet 36 and the lower end of the lever is pivotally secured to the base plate 46.

As will now be evident, when the valve 56 is in its closed position and the pin 84 is urged into the aligned notch 86 by coil spring 88, pin 84 will hold valve stem 62 and connected valve 56 against upward movement caused by the water pressure in the shoe 24. To open the valve 56, the lever 92 is simply pulled to the left in FIG. 1 thereby retracting pin 84 from notch 86. Valve stem 62 and connected valve 56 will then immediately be moved upwards by the water pressure in the shoe 24 thereby moving the valve 56 to its open position. The amount of opening may be varied by providing a plurality of additional notches **86*a* below the notch 86. Thus, if lever 92 is released before valve 56 is in its fully opened position, pin 84 will slip into one of the notches 86*a* thereby securing the valve stem 62 and connected valve 56 in an intermediate position. As shown, all of the notches 86 and 86*a* are chamfered to facilitate release of the pin from the notches when the stem 62 moves downward and to block pin release as the stem moves upward. When valve 56 is fully opened and the lowermost notch 86*a* is above the pin 84, the lever 92 may be released whereupon the pin 84 will slide along the stem 62. Continued upward movement of the stem 62 is ultimately limited by the travel stop 72 which abuts the guide 54 when the valve 56** is in the fully opened position.

It will thus be apparent that the means 82 of frostproof hydrant 10 is reliable for holding the stem 62 and connected valve 56 in the closed position against the water pressure in the shoe. Because the spring 88 is perpendicular to valve stem 62, upward movement of the stem from the closed position is restrained solely by pin 84 with no strain on the spring 88. Even when the lever 92 is moved to retract the pin 84, spring 88 will be subjected to only slight compression. The spring 88 is therefore not likely to lose its elasticity or break, even after prolonged use. To insure reliability of the means 82, pin 84 and lever 92 are preferably comprised of a material of suitable strength, such as a metal or metal alloy.

Figure 2:
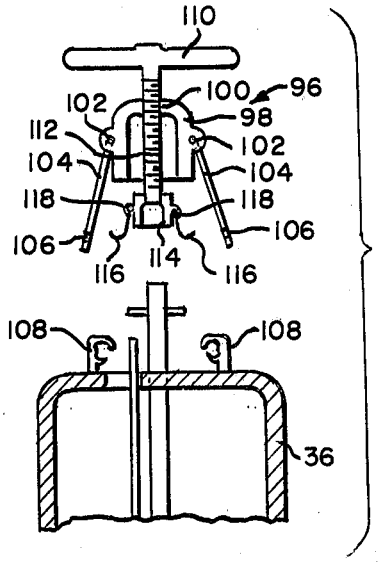
FIG. 2 is a fragmentary elevational view, also partly in section, showing means for reciprocating the valve stem for closing the valve.

While it will be apparent that numerous means may be utilized for reciprocating valve stem 62 and connected valve 56 to close the valve, the detachable means 96 of FIG. 2 is presently preferred. The preferred means 96 includes a generally cylindrical body 98 open at one end, the body 98 having a threaded thru aperture 100 and a pair of ears 102. As shown, a pair of arms 104 are pivotally secured at one end to the ears 102. The free ends of the arms 104 are provided with apertures 106 which are dimensioned to receive hooks 108 on the top of bonnet 36. Means 96 also includes a handwheel 110 having a threaded stem 112 which extends through and mates with the corresponding threads in the aperture 100. As shown, a cap 114 is connected to the lower end of the stem 112 for free rotation thereabout. A pair of hooks 116 dimensioned for mating with the transverse bar 70 are pivotally secured to ears 118 on the cap.

To close valve 56 with means 96, means 96 is disposed on bonnet 36 such that the upper end of the valve stem 62 is received in the cap 114 and the arms 104 and hooks 116 mate with hooks 108, and bar 70, respectively. It will now be evident that rotation of handwheel 110 will force valve stem 62 and connected valve 56 downwards. The valve 56 is returned to its fully closed position by rotating the handwheel until pin 84 snaps into notch 86 which will be apparent from the fact that water flow through nozzle 32 will cease. The fully closed position can also be indicated by a marking on the stem 62 which is positioned for alignment with the top of the bonnet 36 when the valve 56 is fully closed. During closing, it is not necessary to hold the lever 92 in its retracted position since pin 84 will be automatically urged out of the notches 86*a* by the chamfered surfaces of the notches as the stem 62 is moved downwards.

Figure 3:
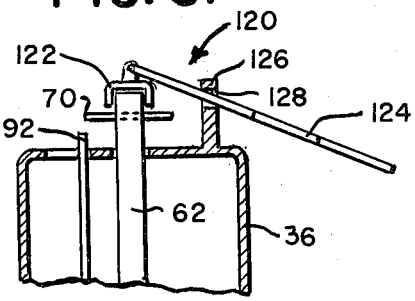
FIG. 3 is a fragmentary view similar to FIG. 2, showing an alternative means for reciprocating the valve stem for closing the valve.

An alternative mechanism 120 for closing valve 56 is illustrated in FIG. 3. As shown, the mechanism 120 comprises a cap 122 which seats on top of the valve stem 62 and a preferably telescoping lever arm 124 pivotally secured to the top of the cap 122. As shown, the bonnet 36 is provided with an upstanding flange 126 having a thru aperture 128 through which arm 124 extends. It will therefore be apparent that the valve stem 62 may be moved to its closed position by simply lifting the free end of the arm 124 which will pivot about the flange 126 and apply downward pressure on the stem 62 through the cap 122. Clearly, once this description is known, still other arrangements for moving stem 62 downward to close valve 56 will suggest themselves to those skilled in the art. For example, while a detachable mechanism for closing the valve is preferred because it accommodates use of a single mechanism in connection with a plurality of hydrants thereby reducing costs, it is not mandatory and arrangements fixed on top of the bonnet 36 may also be used.

Having now described the preferred embodiment of a hydrant according to the present invention and suggested certain modifications thereto, those skilled in the art will appreciate that additional changes and modifications may be made without departing from the spirit and scope of the invention. Accordingly, the above description should be construed as illustrative and not in a limiting sense, the scope of the invention being defined by the following claims:

I claim:

1. In a fire hydrant including a vertical barrel defining a passage adapted for connection to a shoe; a bonnet having a thru aperture secured to the upper end of the barrel; a valve stem disposed in said barrel for reciprocating movement in said passage with one end of said stem extending through said aperture; and valve means connected to the other end of said stem for reciprocating movement therewith between an open position wherein said shoe communicates with said passage and a closed position wherein communication between said shoe and said passage is blocked, said valve means being arranged for movement to said open position by the fluid pressure in said shoe when upward movement of said stem is unblocked and to said closed position against the fluid pressure in said shoe upon downward movement of said stem; the improvement which comprises:

a pin moveably secured to said bonnet;

said stem having a hole for receiving said pin;

a lever connected to said pin for moving said pin between a first position wherein said pin is in said hole when said valve is in said closed position and a second position wherein said pin is out of said hole, said bonnet having an additional aperture therein, one end of said lever extending through said additional aperture;

means for biasing said pin to said first position and means disposed between said bonnet and said barrel for supporting the other end of said lever, said other end of said lever being pivotally secured to said supporting means.

2. The fire hydrant according to claim 1, wherein said biasing means comprises a spring secured at one end to said pin and at the other end to said bonnet.

3. The fire hydrant according to claim 2, wherein said spring is a coil spring and the axis of said spring is perpendicular to said stem.

4. The fire hydrant according to claim 3, wherein said hole in said stem comprises a notch having a lower defining surface substantially perpendicular to the axis of said stem and an upper defining surface at an angle to said lower defining surface.

5. The fire hydrant according to claim 4, and further comprising an additional notch in said stem below said first-mentioned notch, said additional notch also having a lower defining surface substantially perpendicular to said stem and an upper defining surface at an angle to said lower defining surface.

6. The fire hydrant according to claim 5, and further comprising means for moving said stem downward for closing said valve.

7. The fire hydrant according to claim 6, wherein said stem moving means comprises means securable to said bonnet for engaging said one end of said stem and exerting a downward force thereon.

8. The fire hydrant according to claim 7, wherein said means for engaging said one end of said stem comprises:

a housing securable to said bonnet above said one end of said stem, said housing having an internally threaded hole aligned with said stem;

a bolt threadably received in said hole;

means secured to the lower end of said bolt for engaging said one end of said stem; and means for rotating said bolt for reciprocating movement relative to said housing.

9. The fire hydrant according to claim 7, wherein said means for engaging said one end of said stem comprises:

a fulcrum;

a lever pivotable about said fulcrum with one end of said lever disposed above said one end of said stem; and means secured to said one end of said lever for engaging said one end of said stem.

10. The fire hydrant according to claim 9, wherein said supporting means comprises a plate disposed substantially perpendicular to said stem.

* * * * *